US005674095A

United States Patent [19]

Tanhehco et al.

[11] Patent Number: 5,674,095

[45] Date of Patent: Oct. 7, 1997

[54] CONNECTOR PLUG FOR LOW-VOLTAGE ELECTRICAL APPLICATIONS

[75] Inventors: Benito L. Tanhehco; Steve E. Saad, both of Powell, Tenn.

[73] Assignee: DeRoyal Industries, Inc., Powell, Tenn.

[21] Appl. No.: 689,812

[22] Filed: Aug. 14, 1996

[51] Int. Cl.[6] ..... H01R 13/502

[52] U.S. Cl. ..... 439/731; 439/930

[58] Field of Search ..... 439/701, 731, 439/686, 687, 696, 930, 931

[56] References Cited

U.S. PATENT DOCUMENTS

| | | | |
|---|---|---|---|
| 2,192,737 | 3/1940 | Folsom | 173/361 |
| 2,272,432 | 2/1942 | Rogie | 173/332 |
| 3,049,582 | 8/1962 | Shinn | 174/92 |
| 3,810,075 | 5/1974 | Turner | 439/465 |
| 4,191,444 | 3/1980 | Smith et al. | 439/459 |
| 4,194,805 | 3/1980 | Ayer et al. | 439/465 |
| 4,389,083 | 6/1983 | Normann et al. | 439/453 |
| 4,799,903 | 1/1989 | Deurloo | 439/696 |
| 5,094,632 | 3/1992 | Chen et al. | 439/699 |
| 5,336,114 | 8/1994 | Wang | 439/598 |

*Primary Examiner*—Neil Abrams
*Assistant Examiner*—T. C. Patel
*Attorney, Agent, or Firm*—Paul E. Hodges, P.C.

[57] ABSTRACT

The present invention provides a novel terminal for an end of a cable that includes at least two electrical conductors. One especially suitable cable is one that includes the common constantan and copper conductors employed in thermocouple applications. In accordance with one aspect of the present invention, the terminal includes first and second housing sections which, when combined, define an electrically insulative housing for the receipt and anchoring therein of one end of a cable without the use of fasteners of any type aside from the structural features of the housing sections. The first and second housing sections each comprise a thin planar base having a plurality of projections extending from one surface thereof that are received in frictional mating engagement when the two housing sections are joined. The first housing section includes a pair of thin, flat electrically insulative legs that extend from one end thereof, each of which is adapted to receive along the opposite flat surfaces thereof an electrical conductor, i.e., wire, which extends from the interior of the housing and returns to the interior of the housing where the outboard end thereof is anchored.

9 Claims, 2 Drawing Sheets

CONNECTOR PLUG FOR LOW-VOLTAGE ELECTRICAL APPLICATIONS

FIELD OF INVENTION

This invention relates to terminals for electrical cables, etc., such as low-voltage cables associated with instrumentation. The invention is particularly suitable for certain medical instrumentation applications such as temperature measuring instrumentation.

BACKGROUND OF INVENTION

In certain applications, such as medical applications, it is desirable that the electrical cabling associated with instrumentation be a single-use item to avoid the possibility of cross-contamination between patients, the expense associated with resterilization of the cabling, and/or avoiding the expense associated with inventorying of the cabling between uses.

A major element of cost associated with the fabrication of electrical cabling systems relates to the cost of the terminals for the ends of the cabling. This cost includes both the initial cost of the terminal and the cost associated with assembling the terminal with the conductors that make up the cable. It is desirable therefore that there be provided an inexpensive, but effective, disposable terminal for a low-voltage electrical cable which is made up of at least two electrical conductors.

Among other things, a disposable terminal for a low-voltage electrical cable desirably is quickly and securely affixed to the ends of the conductor of the cable with the prongs of a male terminal being in sure electrical association with the ends of the conductors of the cable. Further, preferably this assembly of the terminal to the cable end is simple to effectuate, hence amenable to automated assembly. For some applications, it is desirable or required that the male prongs of the terminal be readily identifiable relative to one another.

It is therefore an object of the present invention to provide a novel terminal for a low-voltage electrical cable.

It is another object of the present invention to provide a novel terminal for a low-voltage electrical cable in which the terminal is relatively inexpensive to fabricate and easy and quickly assembled onto the end of a cable.

Other objects and advantages of the present invention will be recognized from the description contained herein including the claims and the drawings in which:

SUMMARY OF INVENTION

Figure 1:
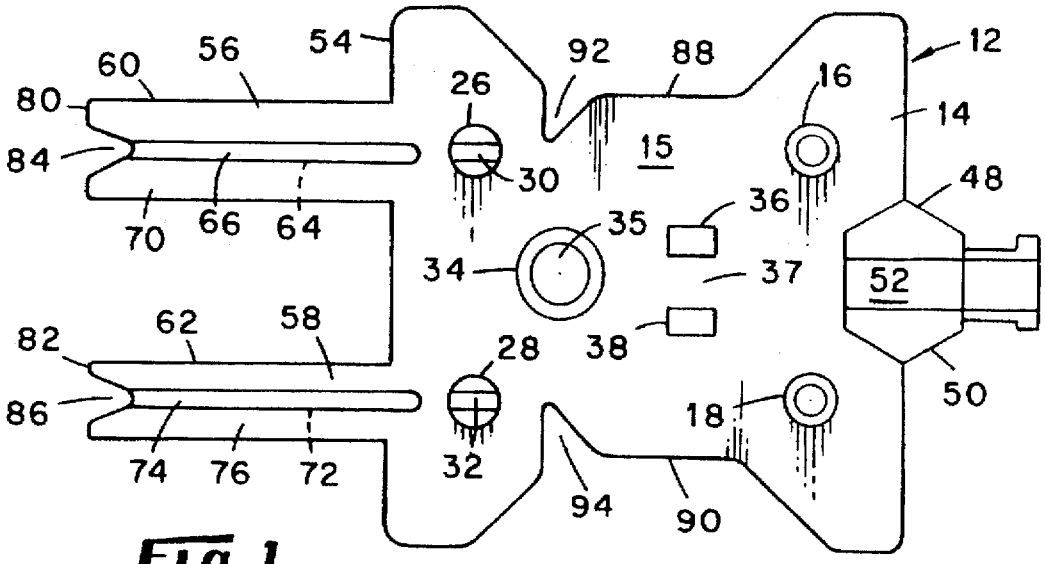
FIG. 1 is a top plan view of a first housing section of a terminal embodying various of the features of the present invention.

The present invention provides a novel terminal for an end of a cable that includes at least two electrical conductors. One especially suitable cable is one that includes the common constantan and copper conductors employed in thermocouple applications. In accordance with one aspect of the present invention, the terminal includes first and second housing sections which, when combined, define an electrically insulating housing for the receipt and anchoring therein of one end of a cable, this housing preferably being of a thin, flat, generally planar, overall geometry, and having a generally hour-glass profile when viewed perpendicularly to the plan view thereof. Accordingly, the housing preferably includes indentations on opposite ones of its side edges which serve as finger grips for grasping the terminal for its insertion into an instrument, a further and mating terminal, or the like, and for removing the same from its engagement with the instrument, further terminal, etc. The housing sections are fabricated from an electrically insulating material, and in a preferred embodiment each section is transparent. If desired, the first and second sections may be hinged along one side edge thereof.

The first housing section comprises a thin planar base having a plurality of projections extending from one surface thereof. This first housing section further includes a pair of thin, flat electrically insulating legs that extend from one end thereof, each of which is adapted to receive along the opposite flat surfaces thereof an electrical conductor, i.e., wire, which leads from the interior of the housing wraps the outboard end of a leg, and returns to the interior of the housing where the outboard end thereof is anchored.

In a preferred embodiment of each insulating leg, the outboard end thereof is notched to provide for the receipt of the electrical conductor therein as the conductor wraps the outboard end of the leg, thereby serving as a guide for the assembly of the conductor on the leg and assuring that the conductor remains in position on the leg during use. When so wrapped with an electrical conductor, each leg serves as a male prong of the terminal. In one embodiment, the two legs may be chosen to be of different widths to enhance identification of the prongs and to aid in insuring proper polarity of the circuit created when the male prongs are inserted into a mating female receptacle.

One aspect of the present invention includes the provision of means for physically separating the two conductors, when stripped of any insulation, and for the feeding of each of the conductors from the interior of the housing, along the length of a respective leg, around the outboard end of the leg, back along the reverse side the leg, and return to the interior of the housing where the end of the uninsulated conductor is securely anchored, all without the use of fasteners of any type aside from the integral structural features of the housing itself. Among other things, this feature of the present invention employs an electrically insulating post disposed generally centrally of the interior of the housing and about opposite sides of which the two uninsulated lengths of the two conductors are directed to thereby physically separate the conductors. From this post, one conductor is fed toward one side edge of the housing where it is passed out of the housing through a tapered notch provided in the side edge of the first housing section. The conductor is urged inwardly of the tapered notch to frictionally secure the conductor therein.

The conductor is fed from the tapered notch along and within a groove defined in one of the flat surfaces of a first leg, thence wrapped about the end of the first leg, thence along and within a groove defined in the opposite one of the flat surfaces of the first leg and reentered into the interior of the housing. The conductor requires no fasteners other than structural features of the first and second housings for retaining its position with respect to the leg. Within the interior of the housing, and adjacent the reentry location of the conductor, there is provided a post upstanding from the base of the first housing section, which post includes an outwardly and upwardly opening tapered slot into which the conductor is urged in frictional engagement therewith, thereby anchoring the outboard end of the conductor to the post and within the interior of the housing.

The second housing section also includes a flat planar base having a wall defined about the perimeter thereof. Within the confines of this perimetrial wall there is provided a plurality of cylindrical members which depend from the base of this second housing section. Each of these cylindrical members is provided with a hollow central cavity which opens outwardly of the member, and which is designed to register with and receive therein respective ones of the posts defined on the base of the first housing section. In a preferred embodiment, each of the cavities of these cylindrical members is provided with a plurality of tapered projections that extend outwardly from the inner wall of the cavity into the cavity itself. The taper of each projection is chosen to cause the projections to reduce the effective internal circumference of a cavity so that when a post of the first housing section is received in the cavity, the taper of the projections increases the frictional engagement between the post and its encompassing cavity, thereby providing for frictional attachment of the second housing section to the first housing section.

DETAILED DESCRIPTION OF INVENTION

Figure 4:
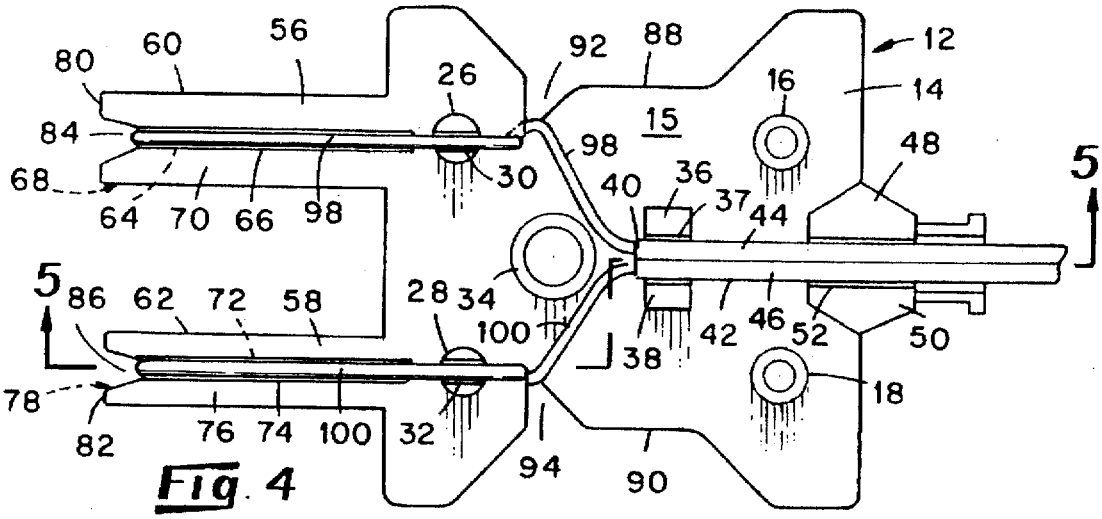
FIG. 4 is a top plan view of the first housing section depicted in FIG. 1 and including electrical conductors mounted thereon.

With reference to the several Figures, and particularly FIGS. 1 and 4, in the depicted embodiment of the present invention there is provided a first housing section indicated generally by the numeral 12 which includes a flat planar base 14 that serves as the mounting platform for a plurality of upstanding post members. First and second ones of these posts 16 and 18, respectively, are cylindrical in shape and serve the functions of positioning of a second housing section indicated generally by the numeral 20 (see FIG. 2) relative thereto when the two housing sections are overlaid, and for frictionally receiving cylindrical posts 22 and 24 of the second housing section in circumferentially engaging relationship.

The first housing section further includes third and fourth posts 26 and 28, respectively, each of which is depicted as a solid post but having an outwardly opening slot 30 and 32, respectively, provided therein. Each of these slots is configured to receive therein an electrical conductor (e.g., a solid wire). To this end, each of slots 30 and 32 tapers inwardly of its respective post to provide increased frictional engagement with the conductor and the sides of the slot as the conductor is urged further into the slot.

Still further, the first housing section includes a plurality of guide members, each of which is in the form of an upstanding projection from the top surface 15 of the base 14. A first guide member 34 is cylindrical in shape, having a hollow central cavity 35, and extends upwardly from the surface 15 of the base 14. This guide member serves to maintain separation of uninsulated ends of electrical conductors as will be apparent hereinafter. Second and third guide members 36 and 38, as depicted, comprise a pair of cooperating posts that extend upwardly from the surface 15 of the base 14 and which are spaced adjacent to, but spaced apart from, one another by a distance that defines an open passageway 37 therebetween which is suitable to receive therein one end 40 of a cable 42 comprising a pair of insulated electrical conductors 44 and 46. Fifth and sixth guide members 48 and 50 likewise extend upwardly from the surface 15 of the base 14 and are spaced apart from one another by a distance that defines a further open passageway 52 that is also suitable to receive therein a portion of the length of the cable 42.

As seen in FIG. 1, the base 14 of the first housing section 12 is provided at one end 54 thereof with first and second thin flat planar legs 56 and 58, which define respective male prongs 60 and 62 for the terminal. Wire-eceiving grooves 64 and 66 are provided on the opposite flat surfaces 68 and 70 of the first prong 60 and like grooves 72 and 74 are provided on the opposite flat surfaces 76 and 78 of the second male prong 62. The outboard ends 80 and 82 of the male prongs are each provided with an outwardly opening notch 84 and 86, respectively.

In each of the opposite side edges 88 and 90 of the base 14, and at a location approximately ⅓ of the length dimension of the base from the end 52 of the base, there are provided outwardly opening, preferably tapered, respective slots 92 and 94, respectively.

Figure 5:
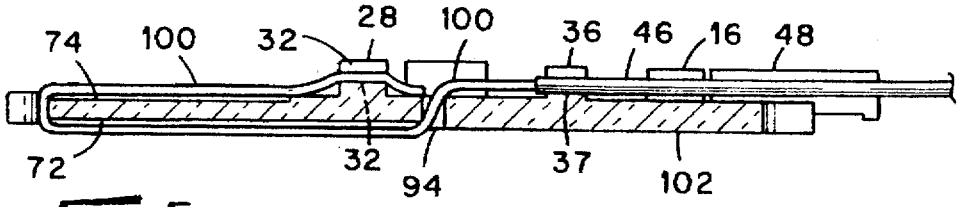
FIG. 5 is a side elevation view, in section, taken along the line 5—5 of FIG. 4.

As depicted in FIGS. 4 and 5, the base 14 of the first housing section serves as the mounting platform for the cable 42 comprising two electrical conductors 44 and 46. As shown in FIG. 4, a portion of the length of the cable 42 is laid into the passageway 52 and extends into and through the passageway 37 where the insulation of the cable is ended. Uninsulated lengths 98 and 100 of the electrical conductors 44 and 46 extend from the end 40 of the cable. The electrically noninsulated length 98 of the conductor 44 is fed from the cable end 40 across the surface 15 of the base and into and through the notch 92 to the reverse surface 102 of the base 14, thence along and within the groove 64 that extends from the notch 92 and along the reverse side 68 of the first prong 60 to a location adjacent to the outboard end of the first prong 60, thence overlaid in the notch 84 and wrapped about the end 80 of the first prong, thence along and within the groove 66 in the surface 70 of the first prong and reenters the housing, thence into and through the length of the slot 30 in the post 26. A short length of the conductor 98 extends from the post 26 as seen in FIGS. 4 and 5. The uninsulated length 100 of the conductor 46 is fed from the cable end 40 across the top surface 15 of the base and into and through the notch 94 to the reverse surface 102 of the base, thence along and within the groove 72 defined on one of the flat surfaces 78 of the second prong 62, thence overlaid in the notch 86 and wrapped about the end 82 of the second prong, thence along and within the groove 74 in the surface 76 of the second prong and reentering the housing, thence into and through the length of the slot 32 in the post 28. A short length of the conductor 100 extends from the post 28.

Figure 2:
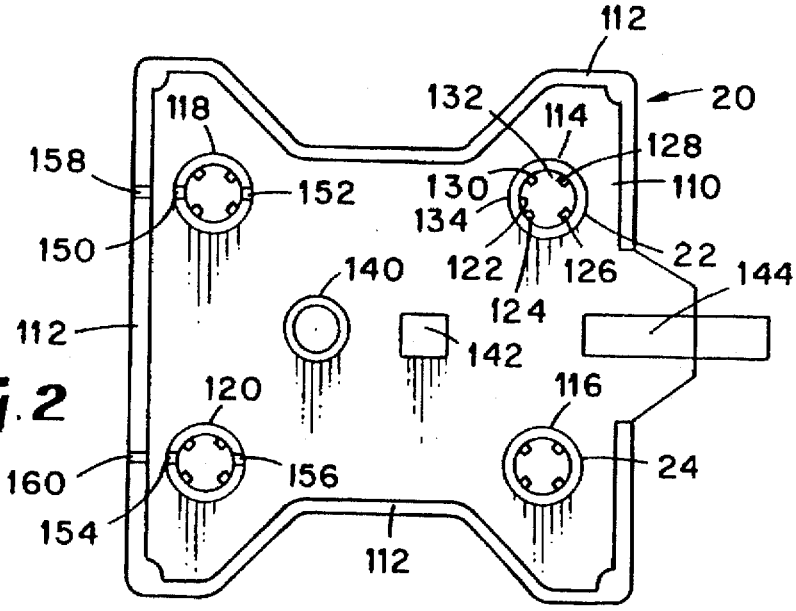
FIG. 2 is a top plan view of a second housing section of a terminal embodying various of the features of the present invention and which cooperatively with the first housing section defines an electrically insulating housing of the terminal of the present invention.

With reference to FIG. 2, the housing of the present terminal includes a second housing section 20 which is designed to be received in mating relationship onto the plurality of posts 16, 18, 26, and 28, as well as the guide members 34, 36, 38, 48 and 50, of the base 14 of the first housing section. To this end, the second housing section 20 comprises a base 110 which is flat and planar and is provided with a wall 112 that extends substantially around the perimeter of the base 110. Within the confines of the wall 112 and extending outwardly from the base 110, there are provided first, second, third and fourth cylindrical posts 114 116, 118, and 120, respectively. On the internal wall of each cylindrical post (wall 122 of first post 114, for example), there is provided a plurality of tapered projections 124, 126, 128, and 130, that extend inwardly of the central cavity of the cylindrical post from the internal wall thereof. The taper of each of the projections 124, 126, 128 and 130 extends from a minimum extent of projection into the central cavity of the post (cavity 132 of post 114, for example) at the outer rim 134 of the cavity 132 to a selected maximum extent of projection into the central cavity 132. Preferably, the four tapered projections provided within the central cavity of each of the posts are spaced apart from one another by 90 degrees about the internal circumference of the cavity. Whereas it is preferred to provide the tapered projections within the central cavities of the cylindrical posts as described, it is to be recognized that the tapered projections could be provided on the exterior surfaces of the posts associated with the first housing section 12.

Also provided within the interior of the second housing section 20 is a fifth cylindrical post 140 having an outside diameter which is suitable for receipt within the cylindrical cavity 35 of the post 34 of the base 14 of the first housing section. There are further provided within the interior of the second housing section 20 a post 142 having a shape suitable for receipt within the passageway 37 of the base 14, and an elongated projection 144 having a shape suitable for receipt within the passageway 52 of the base 14.

Figure 3:
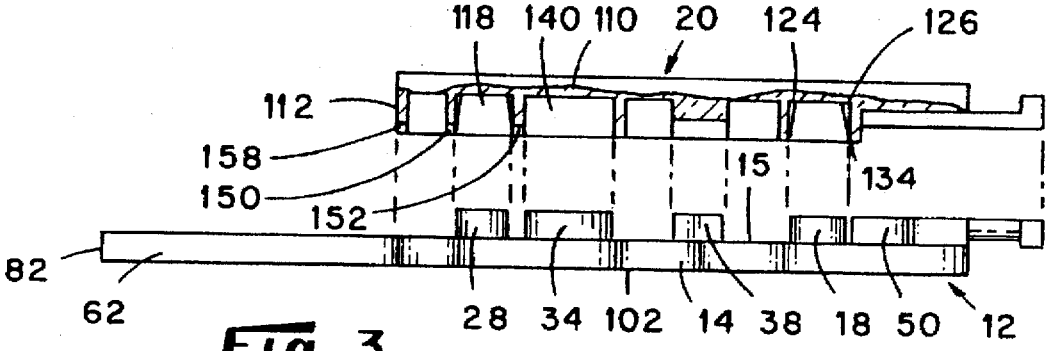
FIG. 3 is a side elevational view, partly in section, of the first and second housing sections depicted in FIGS. 1 and 2 and depicting their assembly into a terminal housing.
Figure 6:
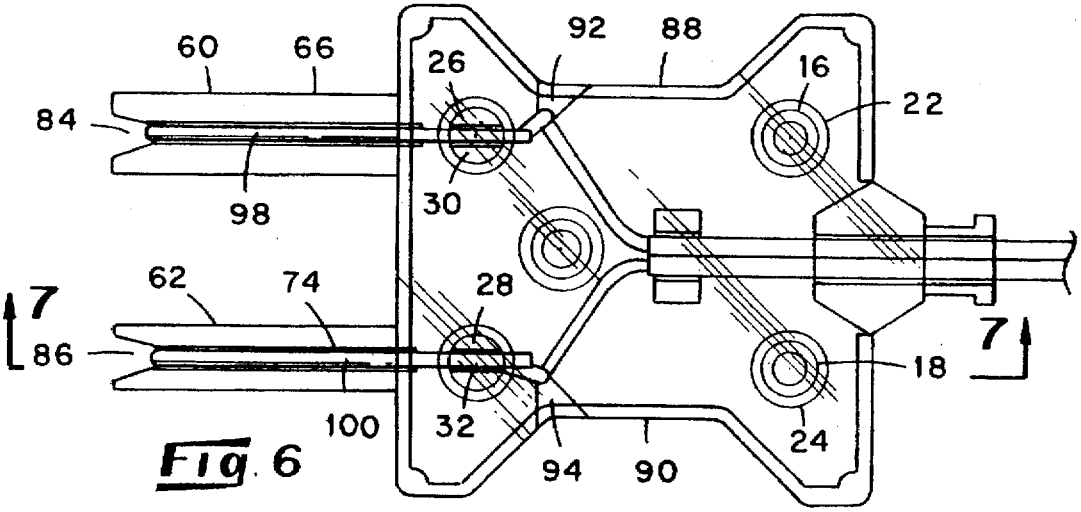
FIG. 6 is a top plan view of an assembled terminal embodying various of the features of the present invention; and, FIG. 7 is a side elevational view of the assembly terminal of FIG. 6, in section, and slightly exaggerated in size to emphasize certain features of the invention.
Figure 7:
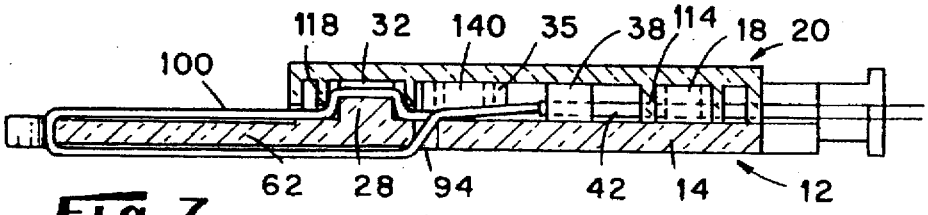

With reference to FIGS. 3, 6 and 7, in particular, the second section 20 of the housing is designed to provide a removable cover for the base 14. In this respect, the spacing of the cylindrical posts 114, 116, 118 and 120 on the base 110 of the second housing section 20 is chosen such that when the second housing section 20 is overlaid on the first housing section 12, the cylindrical posts 114, 116, 118 and 120 are in register with and therefore in position to receive within their respective central cavities, the posts 16, 18, 26 and 28 of the first housing section 12. In a preferred embodiment, the depth of the central cavities of the posts 114, 116, 118, and 120 are selected to fully receive their respective post of the first housing section 12, so that the outer rim of each of the cylindrical posts 114, 116, 118 and 120 contacts the surface 15 of the first housing section 12 when the second housing section 20 is fully positioned on the first housing section 12. Therefore, in a preferred embodiment, the outboard ends of all the posts of the first housing section terminate in a first common plane and the outboard ends of all the posts of the second housing section terminate in a second common plane. In order to further provide this bottoming-out of the outer rims of the posts 118 and 120 and accommodate the conductors 98 and 100 which overlie the top surface of the base 14 of the first housing section 12 in the region adjacent the slotted posts 26 and 28, there are provided grooves 150,152, 154 and 156, respectively, in the outer rim of each of the cylindrical posts 118 and 120 for the receipt therein of the conductors 98 and 100. Further, the wall 112 of the second housing section 20 is similarly provided with grooves 158 and 160 within which are received the conductors 98 and 100 to permit the bottoming-out of the outer rim 140 of the wall in the region thereof where it overlies the conductors 98 and 100 as they reenter the interior of the housing 12 from their respective prongs. In accordance with one aspect of the present invention, the open spaces between tapered protuberances provided on the inner cylindrical wall of each of the cylindrical posts 118 and 120 further serve to receive and accommodate those portions of the lengths of the conductors 98 and 100 which are disposed on the exterior surfaces of the posts 26 and 28 and within the central cavity of the posts 118 and 120 when these latter posts are disposed in covering relationship to the posts 26 and 28.

As noted, the posts 142 and 144 of the second housing section 20 are shaped to be received in the passageways 37 and 52, respectively, of the first housing section 12 when the second housing section is fitted onto the first housing section as described hereinabove. In this manner, these posts 142 and 144 serve to retain the cable 42 securely within the passageways 37 and 52.

In one embodiment, the first and second having sections are molded polycarbonate. Whereas the present invention has been described herein with reference to specific embodiments and/or features, it is to be recognized that the invention is to be limited only as set forth in the claims appended hereto.

What is claimed:

1. A disposable terminal for instrumentation cable including first and second electrical conductors comprising a first housing section including a flat planar base, having first and second side edges, means defining a first outwardly opening notch in said first side edge of said base, means defining a second outwardly opening notch in said second side edge of said base, first and second posts upstanding from said base, each of said first and second posts including means defining an outwardly opening slot in the outboard end thereof which is suitable to receive and secure therein an uninsulated length of one of the first and second electrical conductors, a plurality of further posts upstanding from said base and being spaced apart from one another and from said first and second posts, a plurality of guide members upstanding from said base and defining at least one passageway suitable for guiding the position of a length of the cable on said base, a second housing section including a flat planar base, said base having a like profile to said first housing section and adapted to overly said first housing section in mating relationship thereto to define an interior of the terminal, a plurality of posts upstanding from said base of said second housing section at respective locations that are in register with respective ones of said posts of said first housing section when said second housing section overlies said first housing section, first and second male prongs projecting from one end of said base of said first housing section, each of said prongs including first and second opposite surfaces thereon, first and second uninsulated lengths of the first and second electrical conductors, said length of the first electrical conductor extending from a location within the interior of the terminal along the top surface of the base of said first housing section, thence within and through said first notch in said first side edge of said base, thence along one of said opposite surfaces of said first prong, thence wrapping the end of said first prong, thence along said opposite one of said opposite surfaces of said first prong, thence reentering the interior of the terminal, thence within and through said outwardly opening slot in said first post extending from said base of said first housing section, and said length of the second electrical conductor extending from a location within the interior of the terminal along the top surface of the base of said first housing section, thence within and through said second notch in said second side edge of said base, thence along one of said surfaces of said second prong, thence wrapping the end of said second prong, thence along said opposite one of said opposite surfaces of said second prong, thence reentering the interior of the terminal, thence within and through said outwardly opening slot in said second post that extends from said base of said first housing section, whereby said uninsulated lengths of said electrical conductors are exposed along the respective lengths of respective ones of said first and second prongs.

2. The terminal of claim 1 wherein each of said plurality of further posts extending from said base of said first housing section is cylindrical in shape.

3. The terminal of claim 1 wherein each of said first and second housing sections is fabricated of a transparent electrically nonconductive material.

4. The terminal of claim 1 wherein each of said first and second male prongs is flat and planar.

5. The terminal of claim 1 and including means defining a groove disposed along the length of each of said opposite surfaces of each of said first and second prongs for the receipt therein of an uninsulated length of one of said electrical conductors.

6. The terminal of claim 1 wherein each of said plurality of posts extending from said base of said second housing section is cylindrical in shape and each includes means defining a central cylindrical cavity therein, each of said central cavities being adapted to receive therein a respective one of said plurality of posts extending from said base of said first housing section or a respective one of said first and second posts extending from said base of said first housing section.

7. The terminal of claim 6 and including tapered projections extending from the inner wall of each of the respective central cavities of said plurality of posts extending from said base of said second housing section and into said central cavities, each of said projections projecting minimally into its respective cavity adjacent the outermost rim of said cavity and projecting maximumly into its respective cavity adjacent said base of said second housing section.

8. The terminal of claim 1 and including a plurality of guide means projecting from said top surface of said base of said first housing means and defining at least one passageway for the receipt therein of a cable.

9. The terminal of claim 8 and including a post extending from said base of said second housing section, said post being of a geometry suitable for receipt within said passageway for said cable when said second housing section is overlaid on said first housing section.

* * * * *